US012221960B2

(12) United States Patent
Kim et al.

(10) Patent No.: US 12,221,960 B2
(45) Date of Patent: Feb. 11, 2025

(54) SCROLL COMPRESSOR INCLUDING A VALVE PLATE HAVING A SURFACE PRESSURE ENHANCEMENT PORTION PROTRUDING TOWARD AN INJECTION VALVE

(71) Applicant: Hanon Systems, Daejeon (KR)

(72) Inventors: Kwang Jin Kim, Daejeon (KR); Kyung Jae Lee, Daejeon (KR); Jong Hyun Jeon, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/460,902

(22) Filed: Sep. 5, 2023

(65) Prior Publication Data

US 2024/0084800 A1 Mar. 14, 2024

(30) Foreign Application Priority Data

Sep. 13, 2022 (KR) ..... 10-2022-0115088
Mar. 27, 2023 (KR) ..... 10-2023-0039859

(51) Int. Cl.

| | |
|---|---|
| ***F04C 18/02*** | (2006.01) |
| ***F04C 23/02*** | (2006.01) |
| ***F04C 27/00*** | (2006.01) |
| ***F04C 29/00*** | (2006.01) |
| ***F04C 29/12*** | (2006.01) |

(52) U.S. Cl.

CPC ..... *F04C 18/0215* (2013.01); *F04C 18/0261* (2013.01); *F04C 23/02* (2013.01); *F04C 27/004* (2013.01); *F04C 29/0007* (2013.01); *F04C 29/124* (2013.01); *F04C 29/128* (2013.01); *F04C 2250/10* (2013.01)

(58) Field of Classification Search

CPC ..... F04C 2/025; F04C 18/0207–0292; F04C 29/0007; F04C 29/0014; F04C 29/042; F04C 15/06–068; F04C 29/12–128; F01C 1/0207–0292; F01C 21/001; F01C 21/002; F01C 21/18–186

See application file for complete search history.

(56) References Cited

U.S. PATENT DOCUMENTS

2021/0285445 A1* 9/2021 Bhatia ..... F04C 18/0261
2022/0268282 A1* 8/2022 Lee ..... F04C 29/0007

FOREIGN PATENT DOCUMENTS

| | | | | |
|---|---|---|---|---|
| JP | 2022127624 A | | 8/2022 | |
| KR | 20180094483 A | | 8/2018 | |
| KR | 20210118666 A | * | 10/2021 | |
| KR | 20210118743 A | | 10/2021 | |
| WO | WO-2021015439 A1 | * | 1/2021 | ..... F04C 18/0215 |
| WO | WO-2021194154 A1 | * | 9/2021 | ..... F04C 18/0215 |

* cited by examiner

*Primary Examiner* — Laert Dounis
(74) *Attorney, Agent, or Firm* — James D. Miller; Shumaker, Loop & Kendrick, LLP

(57) ABSTRACT

A scroll compressor including a housing, a motor in the housing, an orbiting scroll, and a fixed scroll. An injection valve assembly is provided between the fixed scroll and the housing and further includes a cover plate, a valve plate, a gasket retainer, and an injection valve. The compressor capable of increasing a surface pressure at a position at which the injection valve of the injection valve assembly needs to be supported, and preventing deformation of the gasket retainer by reducing a bead height of the gasket retainer.

13 Claims, 9 Drawing Sheets

SCROLL COMPRESSOR INCLUDING A VALVE PLATE HAVING A SURFACE PRESSURE ENHANCEMENT PORTION PROTRUDING TOWARD AN INJECTION VALVE

CROSS REFERENCE TO RELATED APPLICATION

The present application claims the benefit of and priority to Korean Pat. Appl. Nos. 10-2022-0115088, filed Sep. 13, 2022, and 10-2023-0039859, filed Mar. 27, 2023, the entire contents of each of which are incorporated herein by reference for all purposes.

FIELD OF THE INVENTION

The present invention relates to a scroll compressor, and more particularly, to a scroll compressor capable of increasing surface pressure at a position at which an injection valve of an injection valve assembly needs to be supported, and preventing deformation of a gasket retainer by reducing a bead height of a gasket retainer.

BACKGROUND OF THE INVENTION

In general, an air conditioning (A/C) device is installed in a vehicle to cool or heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion. Depending on methods of transmitting driving power, the reciprocating compressors are classified into a crank compressor which transmits power to a plurality of pistons using a crank, and a swash plate compressor which transmits power to a shaft on which a swash plate is installed. The rotary compressors are classified into a vane rotary compressor which uses a rotating rotary shaft and vanes, and a scroll compressor which uses an orbiting scroll and a fixed scroll.

The scroll compressor has an advantage in that the scroll compressor may obtain a relatively higher compression ratio than other compressors, smoothly perform processes of introducing, compressing, and discharging the refrigerant, and thus obtain stable torque. Therefore, the scroll compressor is widely used to compress the refrigerant in an air conditioning device or the like.

Patent Document 1 (KR 10-2018-0094483 A) discloses a scroll compressor in the related art that performs a series of processes of sucking only a refrigerant with suction pressure into a compression chamber, compressing the refrigerant, and then discharging the refrigerant to the outside. However, the scroll compressor in the related art has a problem in which a discharge amount of the refrigerant to be discharged from the compression chamber is determined, which causes a limitation in improving the performance and efficiency of the compressor.

To solve the problem, as illustrated in FIGS. 1 and 2, Patent Document 2 (KR 2021-0118743 A) discloses a scroll compressor equipped with an injection valve assembly 700 including an anti-leakage means and an injection valve configured to open or close an injection flow path that guides a middle-pressure refrigerant, which is introduced from the outside of a compressor, to a compression chamber C.

Specifically, the injection valve assembly 700 includes a cover plate 710, an injection valve 720, a valve plate 730, and a gasket retainer 790 provided as the anti-leakage means. The gasket retainer 790 is tightly interposed between the cover plate 710 and the valve plate 730 and seals a portion between the cover plate 710 and the valve plate 730. Therefore, the injection valve 720 is fixed and tightly interposed between the cover plate 710 and the gasket retainer 790.

To this end, the gasket retainer 790 includes a bead portion 792 protruding from an upper surface of the gasket retainer toward the cover plate 710. In this case, a height h by which the bead portion 792 protrudes is equal to or larger than a thickness t of the injection valve 720.

In particular, to open or close the injection valve 720, an end of a first leg portion 724*a* to which a connection portion 726 is connected needs to be assuredly supported, and an end of a second leg portion 724*b* to which the connection portion 726 is connected needs to be assuredly supported.

However, as illustrated in FIG. 2, a surface of the valve plate 730, which supports the gasket retainer 790, is configured as one flat surface, except for inclined spaces 734. For this reason, there is a problem in that even though the gasket retainer 790 is tightly interposed between the cover plate 710 and the valve plate 730, a sufficient surface pressure may not be formed at a position at which the injection valve 720 needs to be supported.

In addition, because the height h by which the bead portion 792 protrudes needs to be equal to or larger than the thickness t of the injection valve 720, there is a problem in that the gasket retainer is inadvertently deformed by being pressed by the bead portion with a high height.

SUMMARY OF THE INVENTION

The present invention is proposed to solve these problems and aims to provide a scroll compressor capable of increasing surface pressure at a position at which an injection valve of an injection valve assembly needs to be supported, and preventing deformation of a gasket retainer by reducing a bead height of a gasket retainer.

Technical problems to be solved by the present invention are not limited to the above-mentioned technical problems, and other technical problems, which are not mentioned above, may be clearly understood from the following descriptions by those skilled in the art to which the present invention pertains.

An embodiment of the present invention provides a scroll compressor including: a housing; a motor provided in the housing; a rotary shaft configured to be rotated by the motor; an orbiting scroll configured to orbit in conjunction with the rotary shaft; and a fixed scroll configured to define a compression chamber together with the orbiting scroll, in which the housing includes a rear housing configured to define a discharge chamber that accommodates a refrigerant discharged from the compression chamber, in which an injection valve assembly is provided between the fixed scroll and the rear housing, defines, in the rear housing, an introduction chamber into which the refrigerant is introduced from the outside of the housing, and guides the refrigerant in the introduction chamber to the compression chamber, in which the injection valve assembly includes: a cover plate coupled to the rear housing and having an inlet port into which the refrigerant in the introduction chamber is introduced; a valve plate coupled to the cover plate and having an outlet port from which the refrigerant introduced through the inlet port is discharged; a gasket retainer interposed between the cover plate and the valve plate and configured to prevent a leak of the refrigerant; and an injection valve interposed between the cover plate and the gasket retainer and configured to open or close the inlet port, and in which the valve plate has a surface pressure enhancement portion protruding toward the injection valve.

In the embodiment, the surface pressure enhancement portion may be provided on a surface of the valve plate, which faces the gasket retainer, and the surface pressure enhancement portion may at least partially support the gasket retainer and the injection valve.

In the embodiment, the injection valve may include: a head portion configured to open or close the inlet port; and a leg portion extending from the head portion and configured to perform an opening or closing operation, and the surface pressure enhancement portion may be provided at a position corresponding to an end of the leg portion opposite to the head portion.

In the embodiment, the inlet port may be provided as a plurality of inlet ports, the head portion and the leg portion of the injection valve may be respectively provided as a plurality of head portions and a plurality of leg portions, the injection valve may further include a connection portion configured to connect the plurality of leg portions, and a surface pressure enhancement portion may be further provided at a position corresponding to at least a part of the connection portion.

In the embodiment, the surface pressure enhancement portions may be configured as integrally continuous surfaces.

In the embodiment, the surface pressure enhancement portions may be configured as a plurality of surfaces spaced apart from one another at positions corresponding to ends of the leg portions opposite to the head portions and corresponding to at least a part of the connection portion.

In the embodiment, the plurality of inlet ports may include: a first inlet port; and a second inlet port formed independently of the first inlet port, the plurality of head portions may include: a first head portion configured to open or close the first inlet port; and a second head portion configured to open or close the second inlet port, the plurality of leg portions may include: a first leg portion extending from the first head portion and configured to perform the opening or closing operation; and a second leg portion extending from the second head portion and configured to perform the opening or closing operation, the connection portion may connect the first leg portion and the second leg portion, and the surface pressure enhancement portions may include: a first surface pressure enhancement portion provided at a position facing an end of the first leg portion to which the connection portion is connected; a second surface pressure enhancement portion provided at a position facing an end of the second leg portion to which the connection portion is connected; and a connection surface pressure enhancement portion provided at a position facing at least a part of the connection portion.

In the embodiment, the first surface pressure enhancement portion may extend in a width direction of the first leg portion, the second surface pressure enhancement portion may extend in a width direction of the second leg portion, and the first surface pressure enhancement portion and the second surface pressure enhancement portion may be disposed in parallel and spaced apart from each other at a predetermined distance.

In the embodiment, the valve plate may include an inclined space recessed in a base surface from which the surface pressure enhancement portion protrudes, and the first and second surface pressure enhancement portions may each have a lower surface roughness than the inclined space.

In the embodiment, the valve plate may include a positioning groove into which a positioning pin is inserted, and the surface pressure enhancement portion may have an avoidance portion recessed to prevent interference with the positioning groove.

In the embodiment, a stepped portion may be formed around a surface of the valve plate that faces the gasket retainer.

In the embodiment, the stepped portion may be defined by a stepped shape forming surface disposed radially outside the surface pressure enhancement portion and further protruding than a surface of the surface pressure enhancement portion.

In the embodiment, the gasket retainer may include: a retainer portion inclinedly processed in a direction in which the injection valve is opened; and a bead portion protruding from one surface and configured to surround the retainer portion, and the bead portion may face the stepped shape forming surface.

Another embodiment of the present invention provides a scroll compressor including: a housing; a motor provided in the housing; a rotary shaft configured to be rotated by the motor; an orbiting scroll configured to orbit in conjunction with the rotary shaft; and a fixed scroll configured to define a compression chamber together with the orbiting scroll, in which the housing includes a rear housing configured to define a discharge chamber that accommodates a refrigerant discharged from the compression chamber, in which an injection valve assembly is provided between the fixed scroll and the rear housing, defines, in the rear housing, an introduction chamber into which the refrigerant is introduced from the outside of the housing, and guides the refrigerant in the introduction chamber to the compression chamber, in which the injection valve assembly includes: a cover plate coupled to the rear housing and having an inlet port into which the refrigerant in the introduction chamber is introduced; a valve plate coupled to the cover plate and having an outlet port from which the refrigerant introduced through the inlet port is discharged; a gasket retainer interposed between the cover plate and the valve plate and configured to prevent a leak of the refrigerant; and an injection valve interposed between the cover plate and the gasket retainer and configured to open or close the inlet port, and in which a stepped portion is formed around a surface of the valve plate that faces the gasket retainer.

According to the present disclosure, not only the suction-pressure refrigerant but also the middle-pressure refrigerant is introduced into the compression chamber of the scroll compressor, such that the amount of refrigerant to be discharged from the compression chamber may increase, which makes it possible to improve performance and efficiency of the compressor.

In addition, because the surface pressure enhancement portion is formed on the valve plate, the surface pressure may be increased at the position at which the injection valve of the injection valve assembly needs to be supported, i.e., the start portion where the operation of opening or closing the injection valve is performed, which may assuredly support the injection valve.

In addition, because the stepped portion, which is higher than the surface pressure enhancement portion, is formed around the valve plate, which may reduce a bead height of the gasket retainer and prevent the deformation of the gasket retainer.

The effects of the present invention are not limited to the above-mentioned effects, and it should be understood that the effects of the present invention include all effects that may be derived from the configuration of the present invention disclosed in the detailed description of the present invention.

DETAILED DESCRIPTION OF THE INVENTION

Figure 1:
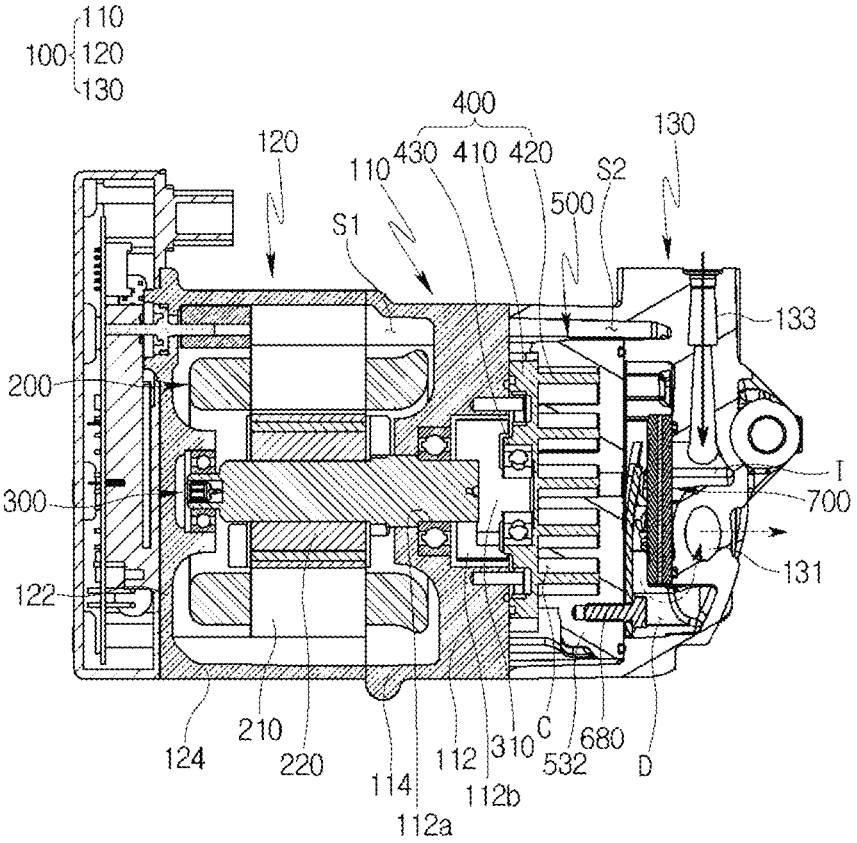
FIG. 1 Prior Art
FIG. 1 is a cross-sectional view illustrating a scroll compressor in the related art.

Hereinafter, exemplary embodiments of a scroll compressor according to the present invention will be described with reference to the accompanying drawings.

In addition, the terms used below are defined considering the functions in the present invention and may vary depending on the intention of a user or an operator or a usual practice. The following embodiments are not intended to limit the protection scope of the present invention.

A part irrelevant to the description will be omitted to clearly describe the present invention, and the same or similar constituent elements will be designated by the same reference numerals throughout the specification. Throughout the specification, unless explicitly described to the contrary, the word "comprise/include" and variations such as "comprises/includes" or "comprising/including" will be understood to imply the inclusion of stated elements, not the exclusion of any other elements.

Figure 2:
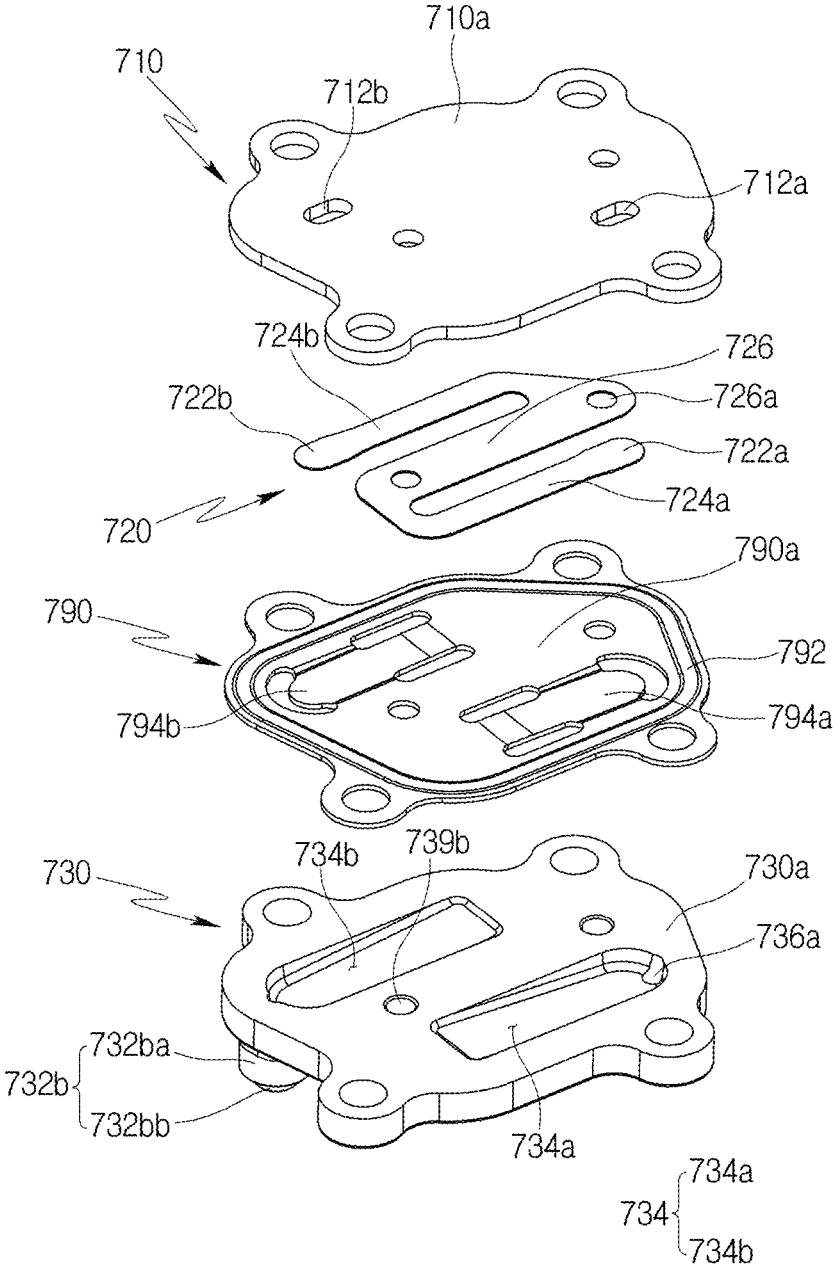
FIG. 2 Prior Art
FIG. 2 is an exploded perspective view separately illustrating an injection valve assembly in FIG. 1.

A scroll compressor according to an embodiment of the present invention includes a housing 100, a motor 200 provided in the housing 100, a rotary shaft 300 configured to be rotated by the motor 200, an orbiting scroll 400 configured to orbit in conjunction with the rotary shaft 300, a fixed scroll 500 configured to define a compression chamber C together with the orbiting scroll 400, and a discharge valve 600 disposed on one surface of the fixed scroll 500 and configured to open or close a discharge port 512 of the fixed scroll from which a refrigerant compressed in the compression chamber C is discharged. In this case, the components identical to the components of the scroll compressor of Patent Document 2 illustrated in FIGS. 1 and 2 are denoted by the same reference numerals, and detailed descriptions of the identical components will be omitted.

Further, the scroll compressor according to the present embodiment may further include an injection valve assembly 2700 that defines and opens or closes an injection flow path configured to guide a middle-pressure refrigerant to the compression chamber C from the outside of the housing 100 (e.g., from a downstream side of a condenser in a vapor compression refrigeration cycle including a scroll compressor, the condenser, an expansion valve, and an evaporator).

The housing 100 includes a center housing 110 penetrated by the rotary shaft 300, a front housing 120 configured to define a motor accommodation space that accommodates the motor 200, and a rear housing 130 configured to define a discharge chamber D that accommodates the refrigerant discharged from the compression chamber C. The injection valve assembly 2700 may be interposed between the fixed scroll 500 and the rear housing 130. The injection valve assembly 2700 defines, in the rear housing 130, an introduction chamber I into which the refrigerant is introduced from the outside of the housing. The injection valve assembly 2700 guides the refrigerant in the introduction chamber I to the compression chamber C.

Figure 3:
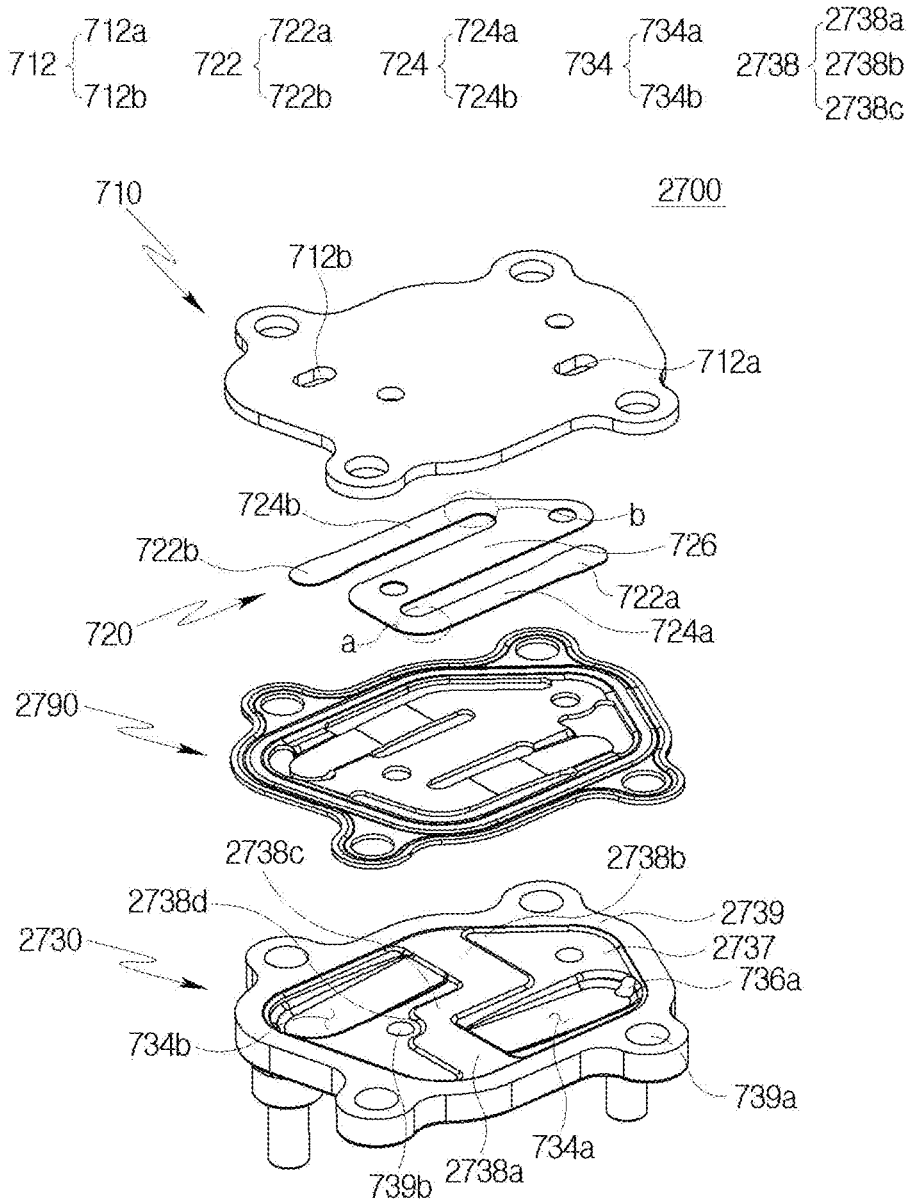
FIG. 3 is an exploded perspective view illustrating an injection valve assembly of a scroll compressor according to an embodiment of the present invention.

Specifically, as illustrated in FIG. 3, the injection valve assembly 2700 includes a cover plate 710 coupled to the rear housing 130 and having inlet ports 712 into which the refrigerant in the introduction chamber I is introduced, a valve plate 2730 coupled to the cover plate 710 and having an outlet port 736 from which the refrigerant introduced through the inlet ports 712 is discharged, a gasket retainer 2790 interposed between the cover plate 710 and the valve plate 2730 and configured to prevent a leak of the refrigerant, and an injection valve 720 interposed between the cover plate 710 and the gasket retainer 2790 and configured to open or close the inlet ports 712. In this case, the components identical to the components of the scroll compressor of Patent Document 2 are denoted by the same reference numerals, and detailed descriptions of the identical components will be omitted. That is, the configurations of the cover plate 710 and the injection valve 720 are identical to those of the scroll compressor of Patent Document 2.

Figure 4:
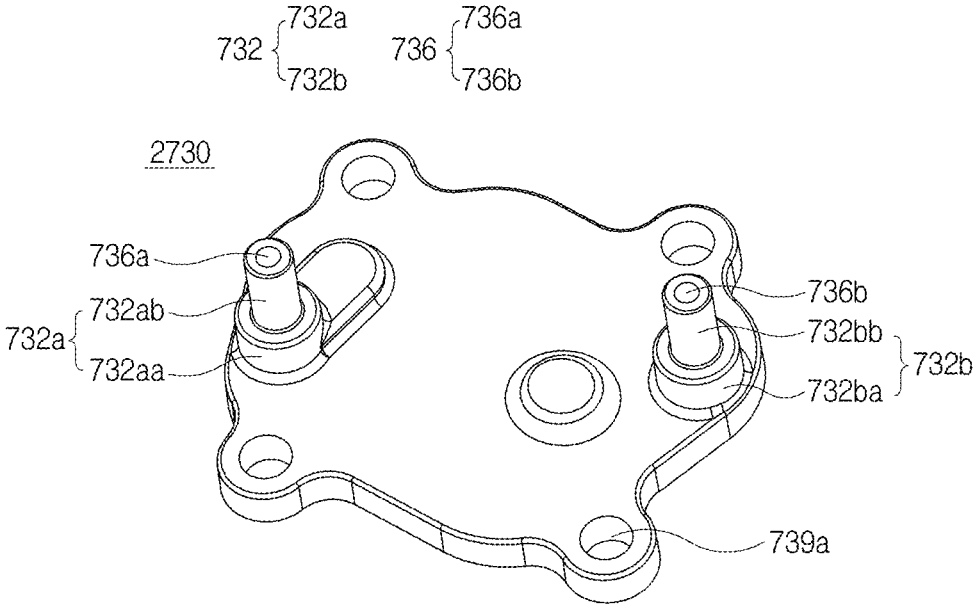
FIG. 4 is a rear perspective view separately illustrating a valve plate in FIG. 3.

As illustrated in FIGS. 3 and 4, the valve plate 2730 of the present embodiment is identical to the valve plate 730 of Patent Document 2 in that the protruding portion 732, the inclined spaces 734, the outlet port 736, the first fastening hole 739*a*, and the second positioning groove 739*b* are applied in the same way. However, the valve plate 2730 of the present embodiment differs from the valve plate 730 of Patent Document 2 in that surface pressure enhancement portions 2738 and a stepped portion are formed on a surface of the valve plate 2730 that faces the gasket retainer 2790. That is, in Patent Document 2, the surface of the valve plate 730, which faces the gasket retainer 790, is formed as a flat surface, except for the inclined spaces 734. However, in the present embodiment, three surfaces with different heights are provided on the surface of the valve plate 2730, which faces the gasket retainer 2790, except for the inclined spaces 734. Hereinafter, the surface of the valve plate 2730, which faces the gasket retainer 2790, is referred to as an upper surface, and a surface opposite to the surface of the valve plate 2730, which faces the gasket retainer 2790, is referred to as a rear surface.

Specifically, the upper surface of the valve plate 2730 has a base surface 2737 in which the inclined spaces 734 are recessed. In addition, the upper surface of the valve plate 2730 has the surface pressure enhancement portion 2738 protruding from the base surface 2737 toward the injection valve 720. That is, a height of the base surface 2737 is lower than that of the surface pressure enhancement portion 2738.

As the surface pressure enhancement portion 2738 protrudes from the base surface 2737, the surface pressure enhancement portion 2738 at least partially support the gasket retainer 2790 and the injection valve 720.

In this case, the surface pressure enhancement portion 2738 may support a start portion of the injection valve 720 where an operation of opening or closing the injection valve 720 is performed. That is, the surface pressure enhancement portion 2738 may support a portion that serves as a reference point at the time of performing the operation of opening or closing the injection valve 720. Therefore, the surface pressure may be increased at the position at which the injection valve 720 needs to be supported, thereby assuredly supporting the injection valve.

Specifically, in case that the injection valve 720 includes head portions 722 configured to open or close the inlet ports, and leg portions 724 extending from the head portions 722 and configured to perform the opening or closing operation, the surface pressure enhancement portion 2738 may be provided at a position corresponding to ends of the leg portions 724 opposite to the head portions 722.

In the present embodiment, as in Patent Document 2, the inlet port 712 is provided as a plurality of inlet ports 712. The plurality of inlet ports 712 includes a first inlet port 712*a* and a second inlet port 712*b* that independently communicate with the introduction chamber I. In addition, in the present embodiment, the head portion 722 and the leg portion 724 of the injection valve 720 are also respectively provided as a plurality of head portions 722 and a plurality of leg portions 724. The injection valve 720 further includes a connection portion 726 that connects the plurality of leg portions 724. In this case, to stably support the injection valve 720, the surface pressure enhancement portion 2738 may be further provided at a position facing at least a part of the connection portion 726.

Specifically, the injection valve 720 includes a first head portion 722*a* configured to open or close the first inlet port 712*a*, a first leg portion 724*a* extending from the first head portion 722*a* and configured to perform the opening or closing operation, a second head portion 722*b* configured to open or close the second inlet port 712*b*, a second leg portion 724*b* extending from the second head portion 722*b* and configured to perform the opening or closing operation, and the connection portion 726 configured to connect the first leg portion 724*a* and the second leg portion 724*b*.

In this case, as illustrated in FIG. 3, the positions at which the injection valve 720 needs to be supported are an end (portion a) of the first leg portion 724*a* to which the connection portion 726 is connected, and an end (portion b) of the second leg portion 724*b* to which the connection portion 726 is connected. This is because the first head portion 722*a* opens or closes the first inlet port 712*a* while being bent about portion a as a reference point, and the second head portion 722*b* opens or closes the second inlet port 712*b* while being bent about portion b as a reference point. Therefore, the surface pressure enhancement portions 2738 may include a first surface pressure enhancement portion 2738*a* provided at a position corresponding to portion a, and a second surface pressure enhancement portion 2738*b* positioned at a position corresponding to portion b, thereby supporting portion a and portion b of the injection valve 720.

In this case, the first surface pressure enhancement portion 2738*a* extends in a width direction of the first leg portion 724*a*, and the second surface pressure enhancement portion 2738*b* extends in a width direction of the second leg portion 724*b*. In particular, the first surface pressure enhancement portion 2738*a* and the second surface pressure enhancement portion 2738*b* may be disposed in parallel and spaced apart from each other at a predetermined distance.

In addition, the surface pressure enhancement portions 2738 include a connection surface pressure enhancement portion 2738*c* provided at a position corresponding to at least a part of the connection portion 726. The connection surface pressure enhancement portion 2738*c* may be disposed in a longitudinal direction of the connection portion 726 and provided between the first and second surface pressure enhancement portion 2738*a* and 2738*b* spaced apart from each other at a predetermined distance. That is, the surface pressure enhancement portions 2738 may be provided at the positions corresponding to portion a and portion b and provided at the position that traverses the injection valve. In the present embodiment, the surface pressure enhancement portions 2738 are configured as integrally continuous surfaces so that the surface pressure enhancement portions 2738 are formed at the same height. That is, the first surface pressure enhancement portion 2738*a*, the second surface pressure enhancement portion 2738*b*, and the connection surface pressure enhancement portion 2738*c* are integrally connected. However, the present invention is not limited thereto. The surface pressure enhancement portions 2738 may be configured as a plurality of surfaces spaced apart from one another. That is, the first surface pressure enhancement portion 2738*a*, the second surface pressure enhancement portion 2738*b*, and the connection surface pressure enhancement portion 2738*c* may be spaced apart from one another.

In addition, in some instances, the surface pressure enhancement portions 2738 may include an avoidance portion 2738*d* formed to be recessed to prevent interference with the second positioning groove 739*b*.

In the embodiment, the first and second surface pressure enhancement portions 2738*a* and 2738*b* may each have lower surface roughness than the inclined spaces 734. Because the inclined space 734 need not be precisely processed, the inclined space 734 may be formed to have a material surface. However, because the first and second surface pressure enhancement portions 2738*a* and 2738*b* are required to uniformly and constantly increase the surface pressure and importantly minimize the tolerance, the first and second surface pressure enhancement portions 2738*a* and 2738*b* need to be formed by precise processing.

Moreover, the upper surface of the valve plate 2730 may not only have the surface pressure enhancement portions 2738 but also have the stepped portion formed around the upper surface of the valve plate 2730. In this case, the stepped portion may be defined by a stepped shape forming surface 2739 disposed radially outside the surface pressure enhancement portions 2738 and further protruding than the surfaces of the surface pressure enhancement portions 2738.

Therefore, the heights of the surface of the valve plate 2730 facing the gasket retainer 2790 decrease in the order of the stepped shape forming surface 2739, the surface pressure enhancement portions 2738, and the base surface 2737.

In this case, the stepped shape forming surface 2739 faces bead portions 2792 of the gasket retainer 2790 to be described below. Therefore, when the injection valve assembly 2700 is fastened to the rear housing 130 by fastening bolts 770, the stepped shape forming surface 2739 may press and deform the bead portion 2792 to form surface pressure and seal a portion between the valve plate 2730 and the cover plate 710.

Further, an inner portion of the gasket retainer 2790 and the injection valve 720 may be seated in a cavity formed inside the stepped shape forming surface 2739. Because the inner portion of the gasket retainer 2790 and the injection valve 720 are seated in the cavity as described above, a height of the bead portion 2792 may be reduced in comparison with Patent Document 2 in which the height h by which the bead portion 792 protrudes needs to be equal to or larger than the thickness t of the injection valve 720. Therefore, it is possible to prevent the deformation of the gasket retainer 2790 and advantageously facilitate the forming of the gasket retainer and maintain a bolt fastening force. This configuration will be described below more specifically together with the description of the gasket retainer 2790.

Figure 5:
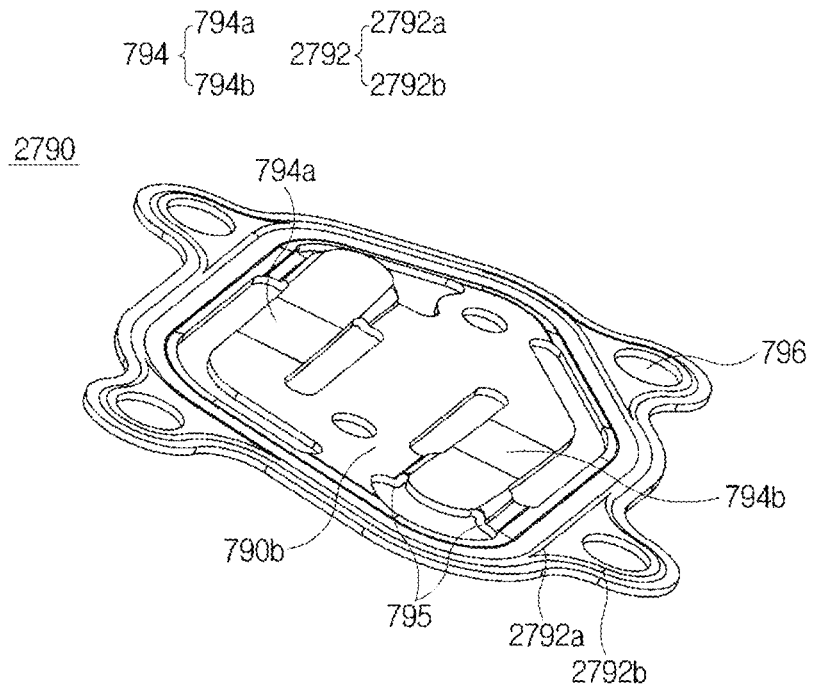
FIG. 5 is a rear perspective view separately illustrating a gasket retainer in FIG. 3.
Figure 6:
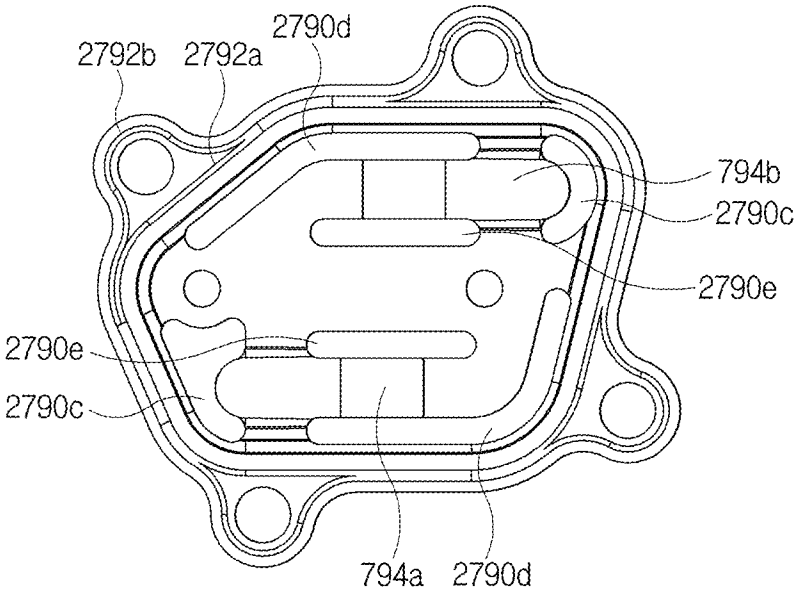
FIG. 6 is a top plan view of FIG. 5.

As in Patent Document 2, with reference to FIGS. 5 and 6, the gasket retainer 2790 of the present embodiment includes retainer portions 794 inclinedly processed in a direction in which the injection valve 720 is opened, and a plurality of third fastening holes 796 disposed and penetratively formed radially outside the retainer portion 794 so that the fastening bolts 770 are inserted into the plurality of third fastening holes 796. However, there is a difference from the related art in that the bead portion 2792 includes a first half-bead 2792*a* and a second half-bead 2792*b* and main flow holes 2790*c* and a pair of auxiliary flow holes 2790*d* and 2790*e* are different in shapes.

Specifically, the bead portion 2792 includes a first half-bead 2792*a* protruding from one surface and extending radially inward from each of the plurality of third fastening holes 796 while surrounding the retainer portion 794, and a second half-bead 2792*b* protruding from one surface and extending radially outward from each of the plurality of third fastening holes 796 while surrounding the first half-bead 2792*a*.

In this case, unlike Patent Document 2, the first half-bead 2792*a* and the second half-bead 2792*b* protrude from a gasket retainer lower surface 790*b* facing the valve plate 2730. However, the present invention is not limited thereto.

In this case, in a portion where the plurality of third fastening holes 796 is spaced apart from one another, i.e., in a space between the adjacent third fastening holes 796, the first half-bead 2792*a* and the second half-bead 2792*b* are in contact with each other to define a full-bead having a convex shape. As illustrated in FIGS. 5 and 6, when the full-bead having a convex shape extends and then approaches the third fastening hole 796, the full-bead is divided into the first and second half-beads 2792*a* and 2792*b*. The first and second half-beads 2792*a* and 2792*b* respectively extend inward and outward from the third fastening hole 796 and then merged, such that the full-bead extends.

For example, the first half-bead 2792*a* and the second half-bead 2792*b* each have a quadrant cross-sectional shape. In the portion where the plurality of third fastening holes 796 is spaced apart from one another, the first half-bead 2792*a* and the second half-bead 2792*b* may be in contact with each other to define a semicircular cross-sectional shape.

Because the bead portions are also formed around the plurality of third fastening holes 796 as described above, the bolt fastening force may be enhanced even at the peripheries of the third fastening holes 796 when the injection valve assembly 2700 is fastened to the rear housing 130 by the fastening bolts 770, which may minimize the deformation of the valve plate 2730.

In particular, the first half-bead 2792*a* and the second half-bead 2792*b* are separately provided to support the fastening bolt 770 at the periphery of the third fastening hole 796 where the surface pressure is high, and the first half-bead 2792*a* and the second half-bead 2792*b* are in contact with each other to define the full-bead at the portion where the third fastening holes 796 are spaced apart from each other and the surface pressure is low. Therefore, the deformation of the valve plate 2730 may be prevented by the uniform surface pressure.

In addition, the gasket retainer 2790 has a hole extending to surround an outer side of one end of the retainer portion 794 to prevent one end of the retainer portion 794, where the inclination is started, from being connected directly to the first half-bead 2792*a*. In the present embodiment, a first auxiliary flow hole 2790*d*, will be described below, serves as the hole extending to surround the outer side of one end of the retainer portion 794. Therefore, the deformation, which is caused when the bead portion 2792 is pressed, is not transferred to an inner portion of the bead portion 2792 that supports the injection valve 720.

Specifically, as in Patent Document 2, the retainer portion 794 is inclinedly processed by cutting a body of the gasket retainer 2790. To maintain an inclination angle of the retainer portion 794, the gasket retainer 2790 further includes a pair of wing portions 795 that connects two opposite sides of the retainer portion 794 and the body of the gasket retainer 2790 that faces the two opposite sides of the retainer portion 794. In this case, the pair of wing portions 795 may be connected to two opposite sides of the other end of the retainer portion 794 opposite to one end of the retainer portion 794 where the inclination is started.

As described above, the bead portion 2792 may not be connected directly to one end of the retainer portion 794 that supports the start portion (reference point) where the operation of opening or closing the injection valve 720 is performed, such that the deformation is not transferred. Further, the pair of wing portions 795 is connected to the other end of the retainer portion 794 by minimum connection, such that the injection valve 720 may be assuredly supported.

The main flow hole 2790*c* is formed at one side of the pair of wing portions 795 and has an approximately U shape while surrounding the other end of the retainer portion 794. The pair of auxiliary flow holes 2790*d* and 2790*e* is formed at the other side of the pair of wing portions 795 and extends in the longitudinal direction of the retainer portion 794. In this case, the first auxiliary flow hole 2790*d* of the pair of auxiliary flow holes, which is positioned at an outer side, extends to be longer than the second auxiliary flow hole 2790*e* positioned at an inner side and surrounds the outer side of one end of the retainer portion 794. That is, as illustrated in FIG. 6, the second auxiliary flow hole 2790*e* may extend straight in the longitudinal direction of the retainer portion 794. The first auxiliary flow hole 2790*d* may extend straight in the longitudinal direction of the retainer portion 794, be bent, and then further extend. The first auxiliary flow hole 2790*d* may extend until it is positioned on the same line as the second auxiliary flow hole 2790*e*. Alternatively, the first auxiliary flow hole 2790*d* may extend until the first auxiliary flow hole 2790*d* exceeds the second auxiliary flow hole 2790*e*.

Specifically, the retainer portion 794 may be provided as a plurality of retainer portions 794. The plurality of retainer portions 794 includes a first retainer portion 794*a* and a second retainer portion 794*b* spaced apart from the first retainer portion. In this case, the first auxiliary flow hole 2790*d* of the first retainer portion 794*a* may extend straight in the longitudinal direction of the first retainer portion 794*a*, be bent toward the main flow hole 2790*c* of the second retainer portion 794*b*, and then extend. The first auxiliary flow hole 2790*d* of the second retainer portion 794*b* may extend straight in the longitudinal direction of the second retainer portion 794*b*, be bent toward the main flow hole 2790*c* of the first retainer portion 794*a*, and then extend.

In some instances, like the main flow hole 2790*c* positioned at a lower side based on FIG. 6, the main flow hole 2790*c* may at least partially extend in a circumferential direction of the gasket retainer 2790.

In the present embodiment, the configuration has been described in which the gasket retainer 2790 is different in structure from the gasket retainer 790 of Patent Document 2. However, the present invention is not limited thereto. The gasket retainer 790 of Patent Document 2 may, of course, be applied.

Figure 7:
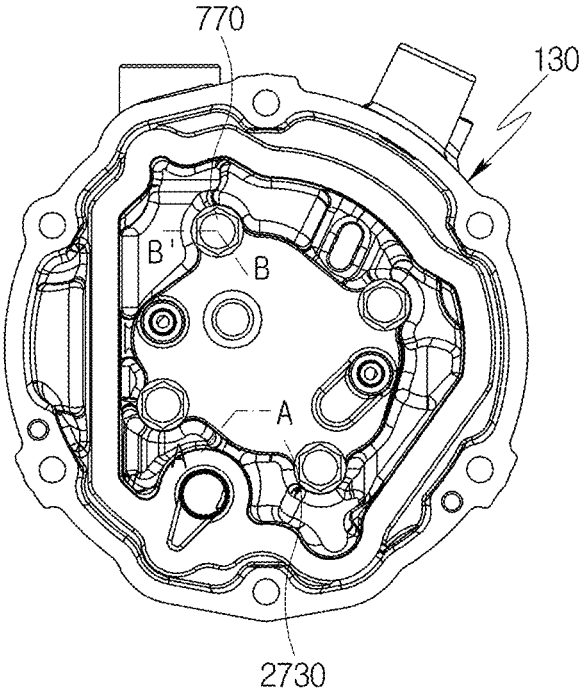
FIG. 7 is a top plan view illustrating a state in which the injection valve assembly in FIG. 3 is fastened to a rear housing.
Figure 8:
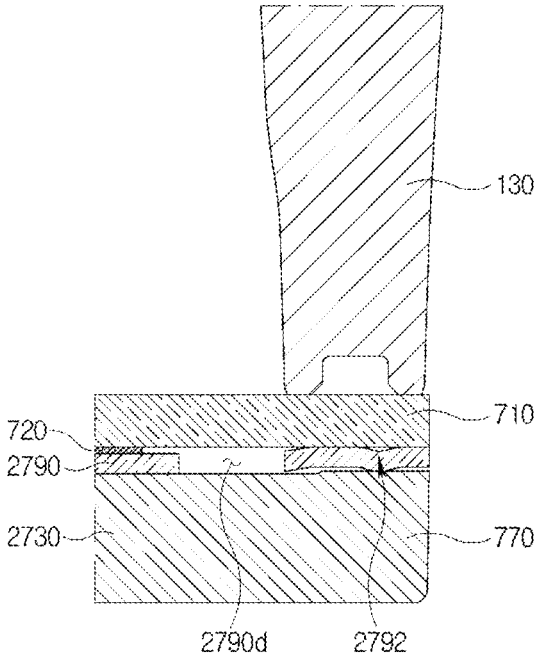
FIG. 8 is a cross-sectional view taken along line A-A' in FIG. 7.

Lastly, a state in which the injection valve assembly 2700 of the present embodiment is coupled to the rear housing 130 will be described with reference to FIGS. 7 to 9. FIG. 8 is a cross-sectional view of a portion spaced apart from the fastening bolt 770, and FIG. 9 is a cross-sectional view of a portion to which the fastening bolt 770 is fastened.

With reference to FIG. 8, at the portion spaced apart from the fastening bolt 770, the first half-bead 2792*a* and the second half-bead 2792*b* of the gasket retainer 2790 meet together to define the full-bead. In addition, the first auxiliary flow hole 2790*d* prevents the retainer portion 794 from being connected directly to the bead portion 2792, such that the deformation of the bead portion 2792 is not transferred to the retainer portion 794. As a result, it can be seen that the retainer portion 794 is kept in a flat state. In addition, the inner portion of the gasket retainer 2790 and the injection valve 720 are seated in the cavity formed inside the stepped shape forming surface 2739 of the valve plate 2730.

Figure 9:
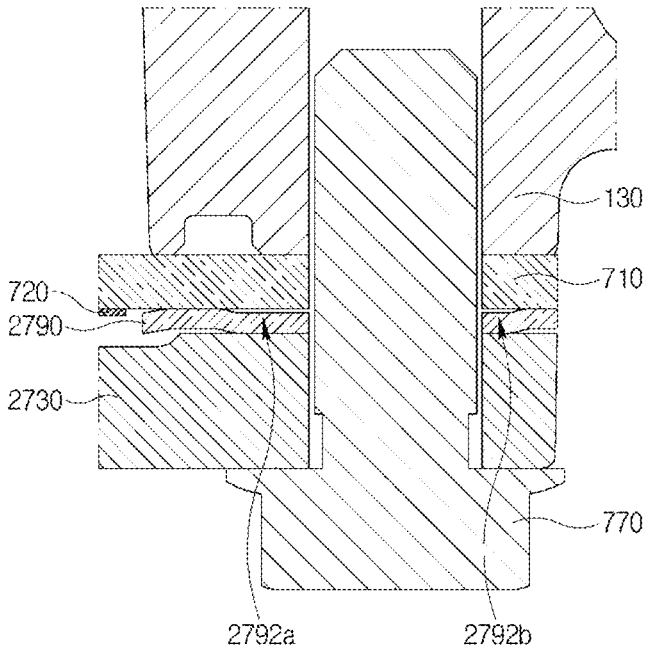
FIG. 9 is a cross-sectional view taken along line B-B' in FIG. 7.

With reference to FIG. 9, at the portion to which the fastening bolt 770 is fastened, it can be seen that the first half-bead 2792*a* and the second half-bead 2792*b* of the gasket retainer 2790 are separately and respectively formed inside and outside the fastening bolt 770. Therefore, it can be seen that the valve plate 2730 may be supported, and the deformation may be minimized. As described above, the deformation of the valve plate 2730 and the gasket retainer 2790 may be minimized, the injection valve 720 may be assuredly supported, and the stable operation may be performed.

The present invention is not limited to the specific exemplary embodiments and descriptions, various modifications can be made by any person skilled in the art to which the present invention pertains without departing from the subject matter of the present invention.

What is claimed is:

1. A scroll compressor comprising:

a housing;

a motor provided in the housing;

a rotary shaft configured to be rotated by the motor;

an orbiting scroll configured to orbit in conjunction with the rotary shaft; and a fixed scroll configured to define a compression chamber together with the orbiting scroll, wherein the housing further comprises a rear housing configured to define a discharge chamber that accommodates a refrigerant discharged from the compression chamber, wherein an injection valve assembly is provided between the fixed scroll and the rear housing, defines, in the rear housing, an introduction chamber into which the refrigerant is introduced from outside of the housing, and guides the refrigerant in the introduction chamber to the compression chamber, wherein the injection valve assembly further comprises:

a cover plate coupled to the rear housing and having an inlet port into which the refrigerant in the introduction chamber is introduced;

a valve plate coupled to the cover plate and having an outlet port from which the refrigerant introduced through the inlet port is discharged;

a gasket retainer interposed between the cover plate and the valve plate and configured to prevent a leak of the refrigerant; and an injection valve interposed between the cover plate and the gasket retainer and configured to open or close the inlet port, wherein a base surface in which an inclined space is recessed is formed on a surface of the valve plate, which faces the gasket retainer, wherein the valve plate has a surface pressure enhancement portion protruding toward the injection valve from the base surface, wherein the base surface is formed lower than the surface pressure enhancement portion, and wherein the surface pressure enhancement portion is provided on the surface of the valve plate, which faces the gasket retainer, and the surface pressure enhancement portion at least partially supports the gasket retainer and the injection valve.

2. The scroll compressor of claim 1, wherein the injection valve further comprises:

a head portion configured to open or close the inlet port; and a leg portion extending from the head portion and configured to perform an opening operation or a closing operation, wherein the surface pressure enhancement portion is provided at a position corresponding to an end of the leg portion opposite to the head portion.

3. The scroll compressor of claim 2, wherein the inlet port is provided as a plurality of inlet ports, wherein the head portion and the leg portion of the injection valve are respectively provided as a plurality of head portions and a plurality of leg portions, wherein the injection valve further comprises a connection portion configured to connect the plurality of leg portions, and wherein the surface pressure enhancement portion is provided as a plurality of surface pressure enhancement portions and is further provided at a position corresponding to at least a part of the connection portion.

4. The scroll compressor of claim 3, wherein the surface pressure enhancement portions are configured as integrally continuous surfaces.

5. The scroll compressor of claim 3, wherein the surface pressure enhancement portions are configured as a plurality of surfaces spaced apart from one another at positions corresponding to ends of the leg portions opposite to the head portions and corresponding to at least a part of the connection portion.

6. The scroll compressor of claim 3, wherein the plurality of inlet ports further comprises:

a first inlet port; and a second inlet port formed independently of the first inlet port, wherein the plurality of head portions further comprises:

a first head portion configured to open or close the first inlet port; and a second head portion configured to open or close the second inlet port, wherein the plurality of leg portions further comprises:

a first leg portion extending from the first head portion and configured to perform the opening operation or the closing operation; and a second leg portion extending from the second head portion and configured to perform the opening operation or the closing operation, wherein the connection portion connects the first leg portion and the second leg portion, and wherein the surface pressure enhancement portions comprise:

a first surface pressure enhancement portion provided at a position facing an end of the first leg portion to which the connection portion is connected;

a second surface pressure enhancement portion provided at a position facing an end of the second leg portion to which the connection portion is connected; and a connection surface pressure enhancement portion provided at a position facing at least a part of the connection portion.

7. The scroll compressor of claim 6, wherein the first surface pressure enhancement portion extends in a width direction of the first leg portion, the second surface pressure enhancement portion extends in a width direction of the second leg portion, and the first surface pressure enhancement portion and the second surface pressure enhancement portion are disposed in parallel and spaced apart from each other at a predetermined distance.

8. The scroll compressor of claim 6, wherein the first surface pressure enhancement portion and the second surface pressure enhancement portion each have a lower surface roughness than the inclined space.

9. The scroll compressor of claim 1, wherein the valve plate further comprises a positioning groove into which a positioning pin is inserted, and the surface pressure enhancement portion has an avoidance portion recessed to prevent interference with the positioning groove.

10. The scroll compressor of claim 1, wherein a stepped portion is formed around a surface of the valve plate that faces the gasket retainer.

11. The scroll compressor of claim 10, wherein the stepped portion is defined by a stepped shape forming surface disposed radially outside the surface pressure enhancement portion and further protruding than a surface of the surface pressure enhancement portion.

12. The scroll compressor of claim 11, wherein the gasket retainer further comprises:

a retainer portion inclinedly processed in a direction in which the injection valve is opened; and a bead portion protruding from one surface and configured to surround the retainer portion, wherein the bead portion faces the stepped shape forming surface.

13. A scroll compressor comprising:

a housing;

a motor provided in the housing;

a rotary shaft configured to be rotated by the motor;

an orbiting scroll configured to orbit in conjunction with the rotary shaft; and a fixed scroll configured to define a compression chamber together with the orbiting scroll, wherein the housing further comprises a rear housing configured to define a discharge chamber that accommodates a refrigerant discharged from the compression chamber, wherein an injection valve assembly is provided between the fixed scroll and the rear housing, defines, in the rear housing, an introduction chamber into which the refrigerant is introduced from outside of the housing, and guides the refrigerant in the introduction chamber to the compression chamber, wherein the injection valve assembly further comprises:

a cover plate coupled to the rear housing and having an inlet port into which the refrigerant in the introduction chamber is introduced;

a valve plate coupled to the cover plate and having an outlet port from which the refrigerant introduced through the inlet port is discharged;

a gasket retainer interposed between the cover plate and the valve plate and configured to prevent a leak of the refrigerant; and an injection valve interposed between the cover plate and the gasket retainer and configured to open or close the inlet port, wherein the valve plate has a surface pressure enhancement portion protruding toward the injection valve, and wherein the valve plate further comprises a positioning groove into which a positioning pin is inserted, and the surface pressure enhancement portion has an avoidance portion recessed to prevent interference with the positioning groove.

* * * * *